US005162290A

United States Patent [19]

Kanto et al.

[11] Patent Number: 5,162,290

[45] Date of Patent: Nov. 10, 1992

[54] HEAT TRANSFER SHEET

[75] Inventors: Jumpei Kanto; Koumei Kafuku; Masayuki Nakamura, all of Tokyo, Japan

[73] Assignee: Dai Nippon Insatsu Kabushiki Kaisha, Japan

[21] Appl. No.: 688,218

[22] Filed: Apr. 22, 1991

[30] Foreign Application Priority Data

Apr. 27, 1990 [JP] Japan ..... 2-110351

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 5,026,678 6/1991 Evans et al. ..... 503/227

FOREIGN PATENT DOCUMENTS

| | | | |
|---|---|---|---|
| 279467 | 8/1988 | European Pat. Off. | 503/227 |
| 416434 | 3/1991 | European Pat. Off. | 503/227 |
| 2382485 | 9/1978 | France | 503/227 |
| 2426717 | 12/1979 | France | 503/227 |
| 63-247092 | 10/1988 | Japan | 503/227 |

*Primary Examiner*—B. Hamilton Hess
*Attorney, Agent, or Firm*—Parkhurst, Wendel & Rossi

[57] ABSTRACT

A heat transfer sheet including (i) a substrate sheet, and (ii) a dye layer which is formed on one surface of the substrate sheet, and includes a binder and a sublimable dye represented by the following formula (I):

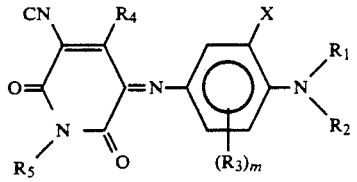

(I)

wherein $R_1$ and $R_2$, which may be the same or different and may form together a five- or six-membered ring which may contain an oxygen atom or a nitrogen atom, are a substituted or unsubstituted alkyl, cycloalkyl, aralkyl or aryl group; $R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group; $R_4$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl, amino, heterocyclic or sulfonyl group; $R_5$ is hydrogen, or a substituted or unsubstituted alkyl, cycloalkyl, alkoxyl, aralkyl, aryl, heterocyclic, acyl, sulfonyl, carbamoyl or sulfamoyl group; X is hydrogen, or an atom or atomic group which forms a five- or six-membered ring together with $R_1$; and m is an integer of 1 or 2.

6 Claims, No Drawings

HEAT TRANSFER SHEET

BACKGROUND OF THE INVENTION

This invention relates to a heat transfer sheet, and more particularly to a heat transfer sheet capable of producing an image which is excellent in color density, sharpness, fastness, and, in particular, preservability.

Heretofore, a variety of heat transfer printing methods have been proposed. Of these, a sublimation-type heat transfer printing method is now prevailing, in which a heat transfer sheet comprising a sublimable dye as a coloring agent (printing agent) which is retained by a substrate sheet such as paper is superposed on a heat transfer image-receiving sheet such as woven cloth of polyester fiber which is receptive to the sublimable dye, and thermal energy is then applied imagewise to the back surface of the heat transfer sheet, thereby transferring the sublimable dye to the heat transfer image-receiving sheet to produce an image therein.

Recently, a heat transfer printing method of the sublimation-type has been proposed which can produce a full-colored image on an image-receiving sheet such as a sheet of paper or a plastic film. In this method, a thermal head of a printer is utilized as a heat application means, and a large number of dots in three or four colors are transferred to the image-receiving sheet in an extremely short heat application time. A full-colored original image can thus be successfully reproduced on the image-receiving sheet.

The image thus obtained is very sharp and clear because a dye is used as a coloring agent. Therefore, the heat transfer printing method of this type can provide an excellent half-tone image with continuous gradation, comparable to an image obtained by offset printing or gravure printing Further, the quality of the image is as high as that of a full-colored photograph.

However, an image produced even by the above printing method is still suffering from the problems of insufficient color density, low preservability, and discoloration which tends to be caused during the preservation thereof over a long period of time.

In order to conduct a high-speed printing, it is required that thermal energy be applied to the heat transfer sheet in an extremely short time of several seconds or less. However, both the sublimable dye contained in the heat transfer sheet, and the heat transfer image-receiving sheet are not sufficiently heated during such a short heat application time. A resultant image, therefore, cannot have sufficiently high color density.

A sublimable dye having high sublimation ability has been developed in order to successfully achieve high-speed heat transfer printing. In general, however, a highly sublimable dye has a low molecular weight. Therefore, when such a dye is employed in a heat transfer sheet, and is transferred to an image-receiving sheet, it tends to easily migrate in the image-receiving sheet, or to bleed out the surface thereof with the passage of time. For this reason, the image produced by the highly sublimable dye has low preservability; more specifically, the image is blurred or its sharpness is reduced during the preservation thereof. In addition, the bled dye stains an article which is brought into contact with the image-receiving sheet.

In order to eliminate the above problems, it may be considered to employ a sublimable dye having a relatively high molecular weight. Such a sublimable dye, however, cannot sublime instantly upon application of heat, so that an image having high color density cannot be obtained by high-speed printing.

SUMMARY OF THE INVENTION

Accordingly, an object of the present invention is to provide a heat transfer sheet for use with a sublimation-type heat transfer printing method, capable of producing an image which is excellent in color density, sharpness, fastness, and, in particular, preservability.

The above object of the invention can be accomplished by a heat transfer sheet comprising a substrate sheet, and a dye layer which is formed on one surface of the substrate sheet, and comprises a binder and a sublimable dye represented by the following formula (I):

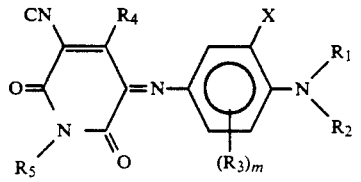

(I)

wherein $R_1$ and $R_2$, which may be the same or different and may form together a five or six-membered ring which may contain an oxygen atom or a nitrogen atom, are a substituted or unsubstituted alkyl, cycloalkyl, aralkyl or aryl group; $R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group; $R_4$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl, amino, heterocyclic or sulfonyl group; $R_5$ is hydrogen, or a substituted or unsubstituted alkyl, cycloalkyl, alkoxyl, aralkyl, aryl, heterocyclic, acyl, sulfonyl, carbamoyl or sulfamoyl group; X is hydrogen, or an atom or atomic group which forms a five- or six-membered ring together with $R_1$; and m is an integer of 1 or 2.

The dye having a specific structure represented by the above formula (I) can be easily transferred to a heat transfer image-receiving sheet upon application of heat even when heat application time is extremely short. Therefore, the heat transfer sheet of the present invention comprising the dye can produce a high-density image which is excellent in sharpness, fastness, and, in particular, preservability.

DETAILED DESCRIPTION OF THE PREFERRED EMBODIMENTS

Preferred embodiments of the present invention will now be explained in detail.

The sublimable dye represented by the formula (I) used in the present invention is readily obtainable by a known method. For example, the dye can be prepared by coupling a pyridone derivative represented by the following formula (a), and a nitroso compound represented by the following formula (b) in the presence of an acid or base:

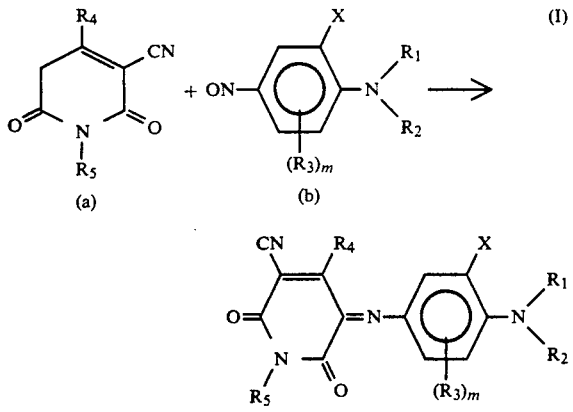

(I)

wherein $R_1$, $R_2$, $R_3$, $R_4$, $R_5$, X, and m are the same as those defined before.

Preferred examples of groups represented by $R_1$, $R_2$, $R_3$, $R_4$ and $R_5$ of the formula (I) include alkyl groups such as a methyl group, an ethyl group, a propyl group and a butyl group; alkoxyalkyl groups such as a methoxyethyl group and an ethoxyethyl group; hydroxyalkyl groups such as a hydroxyethyl group and β-hydroxypropyl group; halogenoalkyl groups such as a chloroethyl group; cyanoalkyl groups such as a cyanomethyl group and a cyanoethyl group; cycloalkyl groups such as a cyclohexyl group; aralkyl groups such as a benzyl group and a phenetyl group; aryl groups such as a phenyl group, a tolyl group, a halogenophenyl group and alkoxyphenyl group; hydrogen; halogens such as chlorine, bromine and iodine; a cyano group; acyl groups such as an acetyl group, a propanoyl group and a benzoyl group; acylamino groups such as an acetylamino group and a benzoylamino group; alkylsulfonyl groups such as a methanesulfonyl group and an ethanesulfonyl group; ureido groups such as a methylureido group, 1,3-dimethylureido group and an ethylureido group; carbamoyl groups such as a methylcarbamoyl group, an ethylcarbamoyl group and a phenylcarbamoyl group; sulfamoyl groups such as a methylsulfamoyl group, an ethylsulfamoyl group and a phenylsulfamoyl group; and amino groups such as a methylamino group, an ethylamino group, a propylamino group, a dimethylamino group and a diethylamino group.

Specific examples of $R_1$ and $R_2$ of the formula (I) include substituted alkyl groups selected from the group consisting of an alkoxyalkyl group, a hydroxyalkyl group, a cyanoalkylbenzyl group, a halogenoalkyl group, an alkylcarboxyalkyl group, an alkylcarbonylalkyl group and an alkoxycarbonylalkyl group, and substituted or unsubstituted lower alkyl groups having 1 to 4 carbon atoms.

Specific examples of $R_3$ and $R_4$ of the formula (I) include a substituted or unsubstituted alkylsulfonylamino group, a substituted or unsubstituted alkylacylamino group, a substituted or unsubstituted alkylsulfonyl group, a substituted or unsubstituted alkylcarbonyl group, and substituted or unsubstituted lower alkyl groups having 1 to 4 carbon atoms.

Specific examples of $R_5$ of the formula (I) include substituted or unsubstituted, linear or branched alkyl groups having 1 to 5 carbon atoms.

It is preferable that the sublimable dye of the present invention have a molecular weight of from 300 to 600.

Listed below in Table 1 are specific examples of the dye having the formula (I), which are favorably employed in the present invention.

TABLE 1

| No. | $R_1$ | $R_2$ | $R_3$ | $R_4$ | $R_5$ | m | Molecular Weight |
|---|---|---|---|---|---|---|---|
| 1 | $-C_2H_5$ | $-C_2H_5$ | $-CH_3$ | $-CH_3$ | $-C_3H_7$ | 1 | 366.5 |
| 2 | $-C_2H_5$ | $-C_2H_5$ | $-H$ | $-CH_3$ | $-C_2H_5$ | 1 | 338.4 |
| 3 | $-C_2H_5$ | $-C_2H_5$ | $-NHCOCH_3$ | $-CH_3$ | $-C_2H_5$ | 1 | 395.5 |
| 4 | $-C_2H_5$ | $-C_2H_4OH$ | $-CH_3$ | $-CH_3$ | $-C_3H_7$ | 1 | 382.5 |
| 5 | $-C_2H_5$ | $-C_2H_4Cl$ | $-CH_3$ | $-CH_3$ | $-C_3H_7$ | 1 | 401.0 |
| 6 | $-C_2H_5$ | $-C_2H_4CN$ | $-CH_3$ | $-CH_3$ | $-C_3H_7$ | 1 | 391.5 |
| 7 | $-C_2H_4CN$ | $-C_2H_4CN$ | $-CH_3$ | $-CH_3$ | $-C_3H_7$ | 1 | 416.5 |
| 8 | $-C_2H_5$ | $-C_2H_5$ | $-CH_3$ | $-C_3H_7$ | $-C_3H_7$ | 1 | 394.6 |
| 9 | $-C_2H_5$ | $-C_2H_5$ | $-Cl$ | $-CH_3$ | -t-$C_4H_9$ | 1 | 400.9 |
| 10 | $-C_2H_5$ | $-C_2H_5$ | $-SO_2C_2H_5$ | $-CH_3$ | $-C_8H_{17}$ | 1 | 514.7 |
| 11 | $-C_2H_5$ | $-C_2H_4Ph$ | $-H$ | $-CH_3$ | $-C_2H_5$ | 1 | 414.5 |
| 12 | $-C_2H_5$ | $-C_2H_5$ | $-NHSO_2CH_3$ | $-CH_3$ | $-C_3H_7$ | 1 | 445.6 |
| 13 | $-C_2H_5$ | $-C_2H_5$ | $-COOC_2H_5$ | $-CH_3$ | $-C_3H_7$ | 1 | 424.6 |
| 14 | $-C_2H_5$ | $-C_2H_5$ | $-CH_3$ | $-CH_3$ | $-C_2H_4OCH_3$ | 1 | 382.5 |
| 15 | $-C_2H_5$ | $-Ph$ | $-H$ | $-CH_3$ | $-C_3H_7$ | 1 | 400.5 |
| 16 | $-C_2H_5$ | $-CH_2Ph$ | $-H$ | $-CH_3$ | $-C_{18}H_{37}$ | 1 | 626.9 |
| 17 | $-C_2H_5$ | $-C_2H_5$ | $-CH_3$ | $-CH_3$ | $-CH_2Ph$ | 1 | 414.5 |
| 18 | $-C_2H_5$ | $-C_2H_5$ | $-CH_3$ | $-CH_3$ | $-C_2H_4OH$ | 1 | 368.5 |
| 19 | $-C_2H_5$ | $-C_2H_5$ | $-OCH_3$ | $-CH_3$ | $-C_3H_7$ | 1 | 382.5 |
| 20 | $-C_2H_4OEt$ | $-C_2H_5$ | $-NHCOMe$ | $-CH_3$ | $-C_4H_9$ | 1 | 467.6 |
| 21 | $-C_2H_4OEt$ | $-C_2H_5$ | $-CH_3$ | $-CH_3$ | $-C_4H_9$ | 1 | 424.5 |
| 22 | $-C_2H_4OEt$ | $-C_2H_5$ | $-NHSO_2Me$ | $-CH_3$ | $-C_4H_9$ | 1 | 503.6 |
| 23 | $-C_2H_4OMe$ | $-C_2H_4OMe$ | $-NHCOMe$ | $-CH_3$ | $-C_4H_9$ | 1 | 483.6 |
| 24 | $-C_2H_4OMe$ | $-C_2H_4OMe$ | $-CH_3$ | $-CH_3$ | $-C_4H_9$ | 1 | 440.5 |
| 25 | $-C_2H_4OMe$ | $-C_2H_4OMe$ | $-NHSO_2Me$ | $-CH_3$ | $-C_4H_9$ | 1 | 519.6 |
| 26 | $-C_2H_4OMe$ | $-C_2H_5$ | $-H$ | $-CH_3$ | $-C_4H_9$ | 1 | 396.5 |
| 27 | $-C_2H_4OMe$ | $-C_2H_4OMe$ | $-H$ | $-CH_3$ | $-C_4H_9$ | 1 | 426.5 |
| 28 | $-C_2H_4OCOMe$ | $-C_2H_5$ | $-H$ | $-CH_3$ | $-C_4H_9$ | 1 | 424.5 |
| 29 | $-C_2H_4OCOMe$ | $-C_2H_5$ | $-NHCOMe$ | $-CH_3$ | $-C_4H_9$ | 1 | 481.6 |
| 30 | $-C_2H_4OCOMe$ | $-C_2H_5$ | $-NHSO_2Me$ | $-CH_3$ | $-C_4H_9$ | 1 | 517.6 |
| 31 | $-C_2H_4OCOMe$ | $-C_2H_4OCOMe$ | $-H$ | $-CH_3$ | -iso$C_4H_9$ | 1 | 482.5 |
| 32 | $-C_2H_4OCOMe$ | $-C_2H_4OCOMe$ | $-NHCOMe$ | $-CH_3$ | $-C_4H_9$ | 1 | 539.6 |
| 33 | $-C_2H_4OCOMe$ | $-C_2H_4OCOMe$ | $-NHSO_2Me$ | $-CH_3$ | $-C_4H_9$ | 1 | 575.6 |
| 34 | $-C_2H_4OPh$ | $-C_2H_5$ | $-H$ | $-CH_3$ | $-C_4H_9$ | 1 | 458.6 |
| 35 | $-C_2H_4OPh$ | $-C_2H_5$ | $-NHCOMe$ | $-CH_3$ | $-C_4H_9$ | 1 | 515.6 |
| 36 | $-C_2H_4OPh$ | $-C_2H_5$ | $-NHSO_2Me$ | $-C_2H_5$ | $-C_4H_9$ | 1 | 551.7 |
| 37 | $-C_2H_4OCOPh$ | $-C_2H_5$ | $-NHCOMe$ | $-CH_3$ | $-C_4H_9$ | 1 | 543.6 |

TABLE 1-continued

| No | $R_1$ | $R_2$ | $R_3$ | $R_4$ | $R_5$ | m | Molecular Weight |
|---|---|---|---|---|---|---|---|
| 38 | $-C_2H_4OCOPh$ | $-C_2H_5$ | $-NHSO_2Me$ | $-CH_3$ | $-C_4H_9$ | 1 | 579.7 |
| 39 | $-C_2H_4OCOOPh$ | $-C_2H_5$ | $-NHCOMe$ | $-CH_3$ | $-C_4H_9$ | 1 | 559.6 |
| 40 | $-C_2H_4OCOOPh$ | $-C_2H_5$ | $-NHSO_2Me$ | $-CH_3$ | $-C_4H_9$ | 1 | 595.7 |
| 41 | *1 | | $-NHCOMe$ | $-CH_3$ | $-C_4H_9$ | 1 | 437.5 |
| 42 | *2 | | $-NHCOMe$ | $-CH_3$ | $-C_4H_9$ | 1 | 421.5 |
| 43 | *3 | | $-NHCOMe$ | $-CH_3$ | $-C_4H_9$ | 1 | 435.5 |
| 44 | *1 | | $-CH_3$ | $-CH_3$ | $-C_4H_9$ | 1 | 394.5 |
| 45 | *4 | $-C_2H_5$ | $-NHCOMe$ | $-CH_3$ | $-C_4H_9$ | 1 | 435.5 |
| 46 | *4 | $-C_2H_5$ | $-CH_3$ | $-CH_3$ | $-C_4H_9$ | 1 | 392.5 |

[NOTE]
In Table 1:
*1: $R_1$ forms the following ring together with and $R_2$:

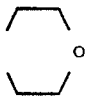

*2: $R_1$ forms the following ring together with and $R_2$:

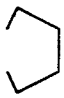

*3: $R_1$ forms the following ring together with and $R_2$: and

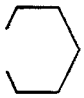

*4: $R_1$ forms the following ring together with X.

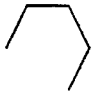

The heat transfer sheet according to the present invention is characterized by comprising the sublimable dye represented by the above formula (I), and it may have the same structure as that of a conventional heat transfer sheet.

Any known material which has been used as the substrate sheet of a conventional heat transfer sheet is employable for the substrate sheet of the present invention as long as it has proper heat resistance and mechanical strength. For instance, paper, processed paper of various kinds, a polyester film, a polystyrene film, a polypropylene film, a polysulfone film, a polycarbonate film, an aramide film, a polyvinyl alcohol film and cellophane can be used as the substrate sheet. Of these, a polyester film is most preferred. The thickness of the substrate sheet is from 0.5 to 50 μm, preferably from 3 to 10 μm.

The dye layer formed on the surface of the above substrate sheet is a layer in which the sublimable dye having the formula (I) is supported by a binder resin.

Any conventional binder resin can be used in the present invention to support the dye. Examples of the binder resin include cellulose resins such as ethyl cellulose, hydroxyethyl cellulose, ethylhydroxy cellulose, hydroxypropyl cellulose, methyl cellulose, cellulose acetate and cellulose butylacetate, and vinyl resins such as polyvinyl alcohol, polyvinyl acetate, polyvinyl butyral, polyvinyl acetacetal, polyvinyl pyrrolidone and polyacrylamide. Of these resins, polyvinyl butyral and polyvinyl acetacetal are preferred when heat resistance and transferability of the dye are taken into consideration.

The dye layer of the present invention is basically prepared by using the binder resin and the sublimable dye having the formula (I). The layer, however, may further comprise conventionally known auxiliary components, if necessary.

The dye layer can be prepared in the following manner:

Namely, the dye having the formula (I), the binder resin, and the auxiliary components are dissolved or dispersed in a proper solvent. The solution or dispersion thus obtained is coated onto the surface of the substrate sheet, and then dried to form a desired dye layer.

The thickness of the dye layer is approximately from 0.2 to 5.0 μm, preferably from 0.4 to 2.0 μm. It is preferable that the amount of the dye be from 5 to 70 wt. %, preferably from 10 to 60 wt. %, of the total weight of the dye layer.

The heat transfer sheet of the present invention may further comprise an adhesion-protective layer, that is, a so-called releasing layer on the surface of the dye layer. The releasing layer can prevent the heat transfer sheet from adhering to an image-receiving sheet when heat transfer is conducted. Also, the printing sheet comprising the releasing layer can withstand higher temperatures than a printing sheet having no releasing layer, so that a larger amount of thermal energy can be applied thereto when conducting heat transfer printing. As a result, an image with higher density can be obtained.

Even the dye layer simply sprinkled with inorganic powder reveals sufficiently high releasing ability. It is, however, more suitable to provide a layer made of resin having high releasing ability such as a silicone polymer, an acrylic polymer or a fluorine-containing polymer as the releasing layer. In this case, the thickness of the releasing layer is from 0.01 to 5 μm, preferably from 0.05 to 2 μm.

To impart the releasing ability to the heat transfer sheet of the present invention, it is also acceptable to incorporate the inorganic powder or the above resin having high releasing ability into the dye layer.

Furthermore, a heat-resistive layer may be provided on the back surface of the heat transfer sheet of the invention. The heat-resistive layer can eliminate adverse effects of heat generated by a thermal head.

Any heat transfer image-receiving sheet which is receptive to the sublimation dye having the formula (I) can be used together with the heat transfer sheet of the present invention for image printing Even those materials which are not receptive to the dye, such as paper, metals, glass and synthetic resins can be used as heat transfer image-receiving sheets if they are provided with a dye-receiving layer on at least one surface of sheets or films of the above materials.

To conduct heat transfer printing by using the heat transfer sheet of the present invention and the above-described heat transfer image-receiving sheet in combination, any conventional means for applying thermal energy is employable. For instance, recording apparatus such as a thermal printer, "Video Printer VY-100" (Trademark) manufactured by Hitachi Co., Ltd., are usable for the purpose. A desired image can be obtained by applying thermal energy in an amount of from 5 to 100 mJ/mm$^2$, which is changeable by controlling the printing time, by the thermal printer to the heat transfer sheet.

The heat transfer sheet of the invention produces an image of cyan in color, so that when it is used together with heat transfer sheets which can respectively produce images of yellow and magenta in color, a full-colored image is obtainable with high reproducibility.

The following heat transfer sheets are preferably used along with the heat transfer sheet of the present invention to produce a full-colored image:

(i) A heat transfer sheet comprising a yellow dye represented by the following formula:

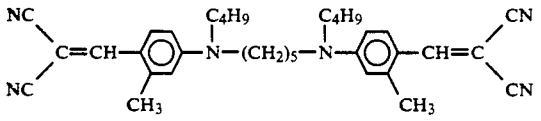

(ii) A heat transfer sheet comprising a magenta dye represented by the following formula:

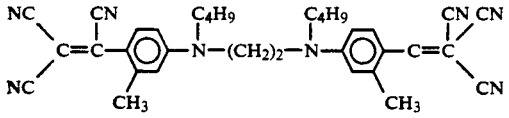

The present invention will now be explained more specifically with reference to the following examples, which are given for illustrating of this invention and are not intended to be limiting thereof Throughout these examples, quantities expressed in "parts" and "percent (%)" are "percent by weight" and "parts by weight", respectively.

REFERENTIAL EXAMPLE 1

1.00 g of a pyridone derivative having the following formula (a'), and 1.25 g of a nitroso derivative having the following formula (b') were dissolved in 40 ml of methanol.

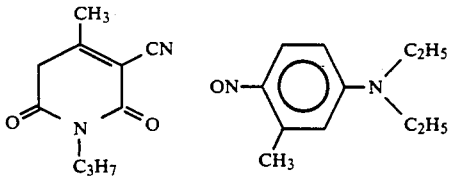

(a') (b')

The resulting mixture was stirred at 60° C. for 6 hours to proceed a reaction. After the reaction was completed, the reaction mixture was cooled to precipitate a reaction product. The crystalline reaction product was then collected by filtration, whereby 1.25 g of a compound, the dye No. 1 of the present invention shown in Table 1, was obtained with an yield of 68%. The dye was determined to have a melting point ranging from 161.5 to 162.2° C.

REFERENTIAL EXAMPLE 2

The dyes Nos. 2 to 46 shown in Table 1 were respectively prepared by using starting materials corresponding to each dye in the same manner as described in Referential Example 1.

EXAMPLE 1

Preparation of Heat Transfer Sheet

Ink compositions for forming a dye layer, having the following formulation, were respectively prepared by using the above-prepared dyes No. 1 to No. 46. The ink compositions were respectively coated onto the back surface of a substrate sheet, a polyethyleneterephthalate film having a thickness of 6 μm, backed with a heat-resistive layer, in an amount of 1.0 g/m$^2$ on dry basis, and then dried, thereby obtaining heat transfer sheets according to the present invention.

| <Formulation of Ink Composition> | |
|---|---|
| Dye shown in Table 1 | 3 parts |
| Polyvinylbutyral resin | 4.5 parts |
| Methyl ethyl ketone | 46.25 parts |
| Toluene | 46.25 parts |

It is noted that a proper solvent such as DMF, dioxane, or chloroform was employed when the dye was insoluble in the above ink composition. In the case where the dye could not be thoroughly dissolved in the composition even if such a solvent was used, a filtrate of the composition was employed as the ink composition.

Preparation of Heat Transfer Image-Receiving Sheet

A coating liquid for forming a dye-receiving layer, having the following formulation, was applied onto one surface of a substrate sheet, a sheet of synthetic paper "Yupo FPG #150" (Trademark) manufactured by Oji-Yuka Synthetic Paper Co., Ltd., in an amount of 10.0 g/m$^2$ on dry basis, and then dried at 100° C for 30 minutes, thereby obtaining a heat transfer image-receiving sheet.

| <Formulation of Coating Liquid for Forming Dye-Receiving Layer> | |
|---|---|
| Polyester resin ("Vylon 200" (Trademark) manufactured by Toyobo Co., Ltd.) | 11.5 parts |

-continued

| <Formulation of Coating Liquid for Forming Dye-Receiving Layer> | |
|---|---|
| Vinyl chloride - vinyl acetate copolymer ("VYHH" (Trademark) manufactured by Union Carbide Japan K.K.) | 5.0 parts |
| Amino-modified silicone ("KF-393" (Trademark) manufactured by Shin-Etsu Chemical Co., Ltd.) | 1.2 parts |
| Epoxy-modified silicone ("X-22-343" (Trademark) manufactured by Shin-Etsu Chemical Co., Ltd.) | 1.2 parts |
| Methyl ethyl ketone/Toluene/Cyclohexanone (weight ratio = 4:4:2) | 102.0 parts |

Printing Test

Each heat transfer sheet was superposed on the heat transfer image-receiving sheet so that the dye layer of the heat transfer sheet faced the dye-receiving sheet of the image-receiving sheet. Thermal energy was then applied to the back surface of the heat transfer printing layer by a thermal head under the following conditions:

| | |
|---|---|
| Electric voltage applied: | 10.0 V |
| Printing time: | 4.0 msec |

Images thus obtained were respectively evaluated with respect to color density, preservability and color tone in the following manner. The results are shown in Table 2.

(1) Color Density

The color density of the image was measured by a densitometer "RD-918" (Trademark) manufactured by MacBeth Corporation in U.S.A.

(2) Preservability

The image-receiving sheet in which the image was printed was preserved at 70° C. for 48 hours. After the preservation, the image was visually observed. The evaluation standard is as follows:

| | |
|---|---|
| ◎: | Sharpness of the image was unchanged, and even when the surface of the image was rubbed with white paper, the paper was not stained at all with the dye; |
| ○: | Sharpness of the image was slightly reduced, and after the above rubbing test, the white paper was found to have been slightly stained with the dye; |
| Δ: | Sharpness of the image was reduced, and after the above rubbing test, the white paper was found to have been stained with the dye; and |
| X: | The image was blurred, and after the above rubbing test, the white paper was found to have been considerably stained with the dye. |

(3) Color Tone

The color tone of the image was visually observed.

TABLE 2

| Dye No. | Color Density | Preservability | Color Tone |
|---|---|---|---|
| 1 | 2.44 | ○ | Navy Blue |
| 2 | 2.58 | Δ | Navy Blue |
| 3 | 2.16 | ○ | Navy Blue |
| 4 | 1.99 | ○ | Navy Blue |
| 5 | 2.15 | ○ | Navy Blue |
| 6 | 2.32 | ○ | Navy Blue |

TABLE 2-continued

| Dye No. | Color Density | Preservability | Color Tone |
|---|---|---|---|
| 7 | 2.16 | ○ | Navy Blue |
| 8 | 2.12 | ○ | Navy Blue |
| 9 | 2.12 | ○ | Navy Blue |
| 10 | 1.59 | ◎ | Navy Blue |
| 11 | 2.18 | ○ | Navy Blue |
| 12 | 1.88 | ○ | Navy Blue |
| 13 | 2.10 | ○ | Navy Blue |
| 14 | 2.32 | ○ | Navy Blue |
| 15 | 2.26 | ○ | Navy Blue |
| 16 | 1.02 | ◎ | Navy Blue |
| 17 | 2.17 | ○ | Navy Blue |
| 18 | 2.03 | ○ | Navy Blue |
| 19 | 2.24 | ○ | Navy Blue |
| 20 | 2.43 | ○ | Navy Blue |
| 21 | 2.21 | ○ | Navy Blue |
| 22 | 2.33 | ○ | Navy Blue |
| 23 | 2.38 | ◎ | Navy Blue |
| 24 | 2.09 | ○ | Navy Blue |
| 25 | 2.17 | ○ | Navy Blue |
| 26 | 2.45 | ○ | Navy Blue |
| 27 | 2.37 | ○ | Navy Blue |
| 28 | 2.14 | ○ | Navy Blue |
| 29 | 2.34 | ○ | Navy Blue |
| 30 | 2.10 | ○ | Navy Blue |
| 31 | 2.11 | ○ | Navy Blue |
| 32 | 2.28 | ◎ | Navy Blue |
| 33 | 2.25 | ◎ | Navy Blue |
| 34 | 2.16 | ○ | Navy Blue |
| 35 | 2.22 | ○ | Navy Blue |
| 36 | 2.17 | ◎ | Navy Blue |
| 37 | 2.25 | ○ | Navy Blue |
| 38 | 2.07 | ○ | Navy Blue |
| 39 | 2.09 | ◎ | Navy Blue |
| 40 | 2.01 | ◎ | Navy Blue |
| 41 | 2.47 | ○ | Navy Blue |
| 42 | 2.39 | ○ | Navy Blue |
| 43 | 2.35 | ○ | Navy Blue |
| 44 | 2.44 | ○ | Navy Blue |
| 45 | 2.51 | ○ | Navy Blue |
| 46 | 2.38 | ○ | Navy Blue |

COMPARATIVE EXAMPLE 1

The procedure in Example 1 was repeated except that the dye used in Example 1 was replaced by C.I. Disperse Blue 14, whereby a comparative heat transfer sheet was obtained.

The heat transfer sheet thus obtained was evaluated in the same manner as in Example 1. The results are shown in Table 3.

COMPARATIVE EXAMPLE 2

The procedure in Example 1 was repeated except that the dye used in Example 1 was replaced by C.I. Disperse Blue 134, whereby a comparative heat transfer sheet was obtained.

The heat transfer sheet thus obtained was evaluated in the same manner as in Example. The results are shown in Table 3.

COMPARATIVE EXAMPLE 3

The procedure in Example 1 was repeated except that the dye used in Example 1 was replaced by C.I. Solvent Blue 63, whereby a comparative heat transfer sheet was obtained.

The heat transfer sheet thus obtained was evaluated in the same manner as in Example 1. The results are shown in Table 3.

COMPARATIVE EXAMPLE 4

The procedure in Example 1 was repeated except that the dye used in Example 1 was replaced by C.I. Disperse Blue 26, whereby a comparative heat transfer sheet was obtained.

The heat transfer sheet thus obtained was evaluated in the same manner as in Example 1. The results are shown in Table 3.

COMPARATIVE EXAMPLE 5

The procedure in Example 1 was repeated except that the dye used in Example 1 was replaced by C.I. Disperse Violet 4, whereby a comparative heat transfer sheet was obtained.

The heat transfer sheet thus obtained was evaluated in the same manner as in Example 1 The results are shown in Table 3.

TABLE 3

| Comparative Example | Color Density | Preservability |
|---|---|---|
| 1 | 0.99 | X |
| 2 | 1.16 | Δ |
| 3 | 2.07 | X |
| 4 | 1.12 | Δ |
| 5 | 1.02 | X |

The dye for use in the heat transfer sheet according to the present invention has a specific structure containing a substituent at a specific position. The dye of the invention, .therefore, has high heat-transferability, is highly dyeable on an image-receiving sheet, and reveals excellent coloring ability, in spite of its extremely high molecular weight as compared with a molecular weight of approximately from 150 to 250 of sublimable dyes, used for conventional heat transfer sheets. Moreover, the dye of the invention which is transferred to an image-receiving sheet does not migrate in the image-receiving sheet, or does not bleed it out during preservation thereof.

An image obtained by using the heat transfer sheet of the invention does not fade when it is exposed to light. Furthermore, the heat transfer sheet of the invention can also eliminate the problem of discoloration of an image which is caused even when it is not directly exposed to light, such as discoloration of an image on a page of a book, or on a sheet preserved in an album or case.

Because of the above-described reasons, an image produced by using the heat transfer sheet of the present invention is excellent in fastness, and resistances with respect to migration, staining and discoloration. Therefore, the image can retain its sharpness and clearness over a prolonged period of time, and does not stain an article which is brought into contact with the image. The present invention can thus successfully overcome various shortcomings resided in the prior art.

What is claimed is:

1. A heat transfer sheet comprising a substrate sheet, and a dye layer formed on one surface of the substrate sheet, the dye layer comprising a binder and a sublimable dye represented by the following formula (I):

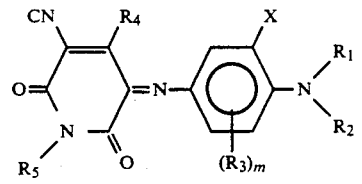

(I)

wherein $R_1$ and $R_2$, which may be the same or different and may form together a five- or six-membered ring which may contain an oxygen atom or a nitrogen atom, are a substituted or unsubstituted alkyl, cycloalkyl, aralkyl or aryl group;

$R_3$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl or amino group;

$R_4$ is hydrogen, halogen, a cyano group, or a substituted or unsubstituted alkyl, cycloalkyl, alkoxyl, aralkyl, aryl, acyl, acylamino, sulfonylamino, ureido, carbamoyl, sulfamoyl, amino, heterocyclic or sulfonyl group;

$R_5$ is hydrogen, or a substituted or unsubstituted alkyl, cycloalkyl, alkoxyl, aralkyl, aryl, heterocyclic, acyl, sulfonyl, carbamoyl or sulfamoyl group;

X is hydrogen, or an atom or atomic group which forms a five- or six-membered ring together with $R_1$; and m is an integer of 1 or 2.

2. A heat transfer sheet according to claim 1, wherein said sublimable dye has a molecular weight of from 300 to 600.

3. A heat transfer sheet according to claim 1, wherein said $R_1$ and $R_2$ of said formula (I) each independently represent a group selected from the group consisting of an alkoxyalkyl group, a hydroxyalkyl group, a cyanoalkylbenzyl group, a halogenoalkyl group, an alkylcarboxyalkyl group, an alkylcarbonylalkyl group, and an alkoxycarbonylalkyl group.

4. A heat transfer sheet according to claim 1, wherein said $R_1$ and $R_2$ of said formula (I) each independently represent a substituted or unsubstituted lower alkyl group having 1 to 4 carbon atoms.

5. A heat transfer sheet according to claim 1, wherein said $R_3$ and $R_4$ of said formula (I) each represent a group selected from the group consisting of a substituted or unsubstituted alkylsulfonylamino group, a substituted or unsubstituted alkylacylamino group, a substituted or unsubstituted alkylsulfonyl group, a substituted or unsubstituted alkylcarbonyl group, and a substituted or unsubstituted lower alkyl group having 1 to 4 carbon atoms.

6. A heat transfer sheet according to claim 1, wherein said $R_5$ of said formula (I) is a substituted or unsubstituted, linear or branched alkyl group having 1 to 5 carbon atoms.

* * * * *